US007631472B2

(12) United States Patent
Lidington

(10) Patent No.: US 7,631,472 B2
(45) Date of Patent: Dec. 15, 2009

(54) INTEGRATED BARREL LOADER AND CONFINER APPARATUS FOR USE IN A CARTONING SYSTEM

(75) Inventor: Frederick Lidington, 5201 Jupiter Hills Ct., Charlotte, NC (US) 28277

(73) Assignee: Frederick Lidington, Charlotte, NC (US)

( * ) Notice: Subject to any disclaimer, the term of this patent is extended or adjusted under 35 U.S.C. 154(b) by 0 days.

(21) Appl. No.: 11/680,745

(22) Filed: Mar. 1, 2007

(65) Prior Publication Data

US 2008/0209867 A1 Sep. 4, 2008

(51) Int. Cl.
*B65B 39/12* (2006.01)
*B65B 39/14* (2006.01)
*B65B 35/20* (2006.01)

(52) U.S. Cl. ..... 53/252; 53/258; 53/566

(58) Field of Classification Search ..... 53/252, 53/257, 258, 566; *B65B 39/12, 39/14, 35/20*
See application file for complete search history.

(56) References Cited

U.S. PATENT DOCUMENTS

| | | | | | |
|---|---|---|---|---|---|
| 2,644,625 | A | * | 7/1953 | Currivan | 53/252 |
| 3,906,705 | A | | 9/1975 | Beck et al. | |
| 3,932,983 | A | | 1/1976 | Hughes | |
| 3,974,623 | A | * | 8/1976 | Bate | 53/252 |
| 4,054,019 | A | | 10/1977 | Weichhand et al. | |
| 4,211,054 | A | * | 7/1980 | Sramek | 53/252 |
| 4,221,107 | A | | 9/1980 | Langen | |
| 4,492,069 | A | | 1/1985 | Hewson | |
| 4,578,927 | A | | 4/1986 | Scarpa et al. | |
| 4,872,300 | A | | 10/1989 | Luke | |
| 5,072,573 | A | * | 12/1991 | Tisma | 53/252 |
| 5,388,389 | A | * | 2/1995 | Tisma | 53/252 |
| 5,430,990 | A | * | 7/1995 | Long | 53/252 |
| 5,457,941 | A | * | 10/1995 | Long et al. | 53/252 |
| 5,660,022 | A | * | 8/1997 | Lade et al. | 53/252 |
| 5,768,854 | A | * | 6/1998 | Nannini et al. | 53/252 |
| 5,787,680 | A | * | 8/1998 | Tisma et al. | 53/252 |
| 6,722,653 | B1 | | 4/2004 | Brumberger et al. | |
| 6,912,826 | B2 | * | 7/2005 | Momich | 53/252 |

OTHER PUBLICATIONS

International Search Report and Written Opinion in counterpart International Application No. PCT/US2008/055397, mailed on Jul. 18, 2008.

* cited by examiner

*Primary Examiner*—Stephen F Gerrity
(74) *Attorney, Agent, or Firm*—Summa, Additon & Ashe, P.A.

(57) ABSTRACT

Disclosed is an integrated barrel loader/confiner apparatus useful in a cartoning system for shaping and inserting a product into a carton. The integrated barrel loader/confiner includes an endless confiner cam track and an endless pusher cam track. A confiner element is endlessly driven and cammed by the confiner cam track to align the confiner element with a product to shape the product in a manner suitable for insertion into a carton. A pusher element is endlessly driven and cammed by the pusher cam track to align the pusher element with the thus shaped product and a carton to drive the shaped product into the carton.

19 Claims, 6 Drawing Sheets

52
70
72
62
66
64
67
60
10
10
60'
54

54
52
84
60
76
79
78
60'
86

INTEGRATED BARREL LOADER AND CONFINER APPARATUS FOR USE IN A CARTONING SYSTEM

BACKGROUND OF THE INVENTION

The invention relates to cartoning systems and in particular to cartoning systems for shaping and loading a product into a carton.

Particulate products, such as dry cereal, are typically packaged using a cartoning system including a combination of machines. In a typical cartoning process, initially a vertical form fill machine is used to form a pouch for the product. In this stage of the packaging process, a plastic tube is wrapped around a vertical form, and a lower edge of the plastic tube is sealed to form a pouch. A pre-weighed amount of the product is introduced into the pouch, and an upper region of the plastic tube is sealed to form the top seal of an individual pouch. The filled pouch is then separated from the tube and transported downstream to a series of machines for loading the filled pouch into a carton.

Conventional cartoning systems include a product conveyor having a series of product buckets for transporting the product, such as the filled plastic pouch, to a confiner overlying the product conveyor. The confiner typically includes a series of inverted L shaped confiner elements, which are mounted over the incoming product buckets and cooperate with the product buckets to shape the product pouch. The product conveyor continues to transport the shaped pouch to position the pouch along a barrel loader. The barrel loader includes a series of pusher elements which drive the product from the product bucket into an adjacent carton. A representative cartoning system including a product conveyor, an overlying confiner, and a barrel loader is discussed, for example, in U.S. Pat. No. 3,932,983 to Hughes.

While useful, such cartoning systems can suffer various disadvantages. The separate components of the cartoning system can be relatively complex and expensive. In addition, because the confiner overlies the product conveyor, the combined system can have significant height. Because of the combined height of the system, operators on opposite sides of the system cannot readily communicate with one another. Further, the product pouches and cartons are loaded onto the product conveyor using automated systems. Occasionally, the automated system introduces a product pouch into a product bucket incorrectly so that the pouch is not properly oriented for loading into an adjacent carton. If a pouch is not properly oriented, the pouch can become stuck or jammed within the system, thereby requiring the system to shut down while an operator locates and corrects the product jam. With conventional overlying confiner systems, this process can be cumbersome and time consuming, and thus can result in lost production time.

BRIEF SUMMARY OF THE INVENTION

The present invention is directed to an apparatus useful in a cartoning system for sequentially shaping and inserting a conformable product, such as a pouch including particulate product like cereal, into a carton. The apparatus of the invention integrates the functionality of a product confiner and a barrel loader into a single apparatus. The integrated barrel loader/confiner can have a more compact structure, i.e., lower overall height, as compared to a conventional packaging system that includes a separate barrel loader and overhead confiner. This can allow operators on opposite sides of the integrated barrel loader/confiner apparatus to more effectively communicate with one another. This structure can also facilitate locating and correcting a product or package jam, and thus can minimize operating down times. This in turn can increase the efficiencies and cost effectiveness of a product packaging process.

The integrated barrel loader/confiner of the invention includes a first endless cam track (also referred to herein as a confiner cam track), defining a path of movement for a confiner element to conform or shape a conformable product in a manner suitable for insertion into a carton. The integrated barrel loader/confiner also includes a confiner element endlessly driven along the first cam track. As the confiner element travels along the confiner cam track, the confiner element can be positioned with respect to a conformable product to shape or conform the product. In exemplary embodiments of the invention, the confiner element has an inverted L shape defined by a horizontal top wall and a leading vertical wall.

The integrated barrel loader/confiner also includes a second endless cam track (also referred to herein as a pusher cam track), defining a path of movement for a pusher element to drive a conformed product into a carton. The integrated barrel loader/confiner also includes a pusher element endlessly driven along the second cam track. As the pusher element travels along the pusher cam track, the pusher element can be positioned adjacent a product shaped by the confiner element and can drive the shaped product into a carton.

The integrated barrel loader/confiner of the invention can further include a carriage for carrying a confiner element and a pusher element. An endless chain drives the carriage generally in the machine direction of the integrated barrel loader/pusher.

The carriage includes a first carriage track defining a path along which the confiner element travels in a cross machine direction from a retracted position outwardly to an extended position. A confiner cam follower attached to the confiner element slidably mounts the confiner element to the first carriage track. A confiner cam attached to the confiner cam follower cooperates with the confiner cam track to drive the confiner element along the confiner cam track, and the confiner element travels from a retracted position outwardly to an extended position along the first carriage track as the confiner cam travels along the confiner cam track.

The carriage also includes a second carriage track, which is parallel to the first carriage track and defines a path along which the pusher element travels in a cross machine direction from a retracted position outwardly to an extended position. A pusher cam follower attached to the pusher element slidably mounts the pusher element to the second carriage track. A pusher cam attached to the pusher cam follower cooperates with the pusher cam track to drive the pusher element along the pusher cam track, and the pusher element travels from a retracted position outwardly to an extended position along the second carriage track as the pusher cam travels along the pusher cam track.

In an exemplary embodiment of the invention, the pusher cam track underlies the confiner cam track and the pusher cam follower is inverted and slidably mounted to a lower surface of the second carriage track. In another exemplary embodiment of the invention, the pusher cam track is shaped so that the travel of the pusher element along the second carriage track lags the travel of the confiner element along the first carriage track.

The integrated barrel loader/confiner of the invention can further include a confiner diverter system. The confiner diverter system can engage the confiner cam follower to prevent the confiner element carried by the confiner cam follower from being cammed. In an exemplary embodiment of the invention, the confiner diverter system includes a confiner diverter gate pivotably mounted to the confiner cam track between a first position in which the confiner diverter gate is in alignment with the confiner cam track and a second position in which the confiner diverter gate is pivoted outwardly away from the confiner cam track.

The integrated barrel loader/confiner of the present invention can further include a pusher diverter system. The pusher diverter system can engage the pusher cam follower to prevent the pusher element carried by the pusher cam follower from being cammed. In an exemplary embodiment of the invention, the pusher diverter system includes a pusher diverter gate pivotably mounted to the pusher cam track between a first position in which the pusher diverter gate is in alignment with the pusher cam track and a second position in which the pusher diverter gate is pivoted outwardly away from the pusher cam track.

The present invention also includes a cartoning system. The cartoning system of the invention includes a product conveyor including a series of product buckets. In an exemplary embodiment of the invention, the product buckets are defined by a horizontal bottom wall and spaced-apart vertical walls.

The cartoning system of the invention further includes an integrated barrel loader/confiner adjacent the product conveyor. The integrated barrel loader/confiner includes a first endless cam track (also referred to herein as a confiner cam track) defining a path of movement for a confiner element to juxtapose the confiner element with a product bucket; a confiner element endlessly driven along the first (confiner) cam track; a second endless cam track (also referred to herein as a pusher cam track) defining a path of movement for a pusher element to position the pusher element adjacent a juxtaposed confiner element and product bucket; and a pusher element endlessly driven along the second (pusher) cam track.

The cartoning system can further include a carton conveyor extending parallel to the product conveyor and positioned so that the product conveyor is between the carton conveyor and the integrated barrel loader/confiner. In this embodiment of the invention, the second cam track further defines a path of movement for the pusher element through the juxtaposed confiner element and product bucket to drive a product when present in the product bucket into a carton when carried by the carton conveyor.

In an exemplary embodiment of the invention, the confiner element has an inverted L shape defined by a horizontal top wall and a leading vertical wall. In this embodiment of the invention, the first cam track defines a path of movement for the confiner element to juxtapose the confiner element with the product bucket to define a generally rectangular shape. When the product bucket includes a conformable product, the leading vertical wall of the confiner element can engage a leading surface of the conformable product and gradually force the product rearward while the horizontal top wall confines the product.

The cartoning system of the invention can further include a confiner diverter system. In this embodiment of the invention, the confiner diverter system can include a product sensor for detecting the absence or improper orientation of a product carried in a product bucket. The confiner diverter system can further include a confiner diverter gate pivotably mounted to the confiner cam track between a first position in which the confiner diverter gate is in alignment with the confiner cam track and a second position in which the confiner diverter gate is pivoted outwardly away from the confiner cam track when the absence or improper alignment of a product is detected and communicated by the product sensor to the confiner diverter system.

The cartoning system of the invention can further include a pusher diverter system. In this embodiment of the invention, the pusher diverter system can include a carton sensor for detecting the absence or improper orientation of a carton carried by the carton conveyor. The pusher diverter system can further include a pusher diverter gate pivotably mounted to the diverter cam track between a first position in which the pusher diverter gate is in alignment with the pusher cam track and a second position in which the pusher diverter gate is pivoted outwardly away from the pusher cam track when the absence or improper alignment of a carton is detected and communicated by the carton sensor to the pusher diverter system.

The foregoing, as well as other objectives and advantages of the invention and the manner in which the same are accomplished, are further discussed within the following detailed description and its accompanying drawings.

BRIEF DESCRIPTION OF THE DRAWINGS

Figure 1:
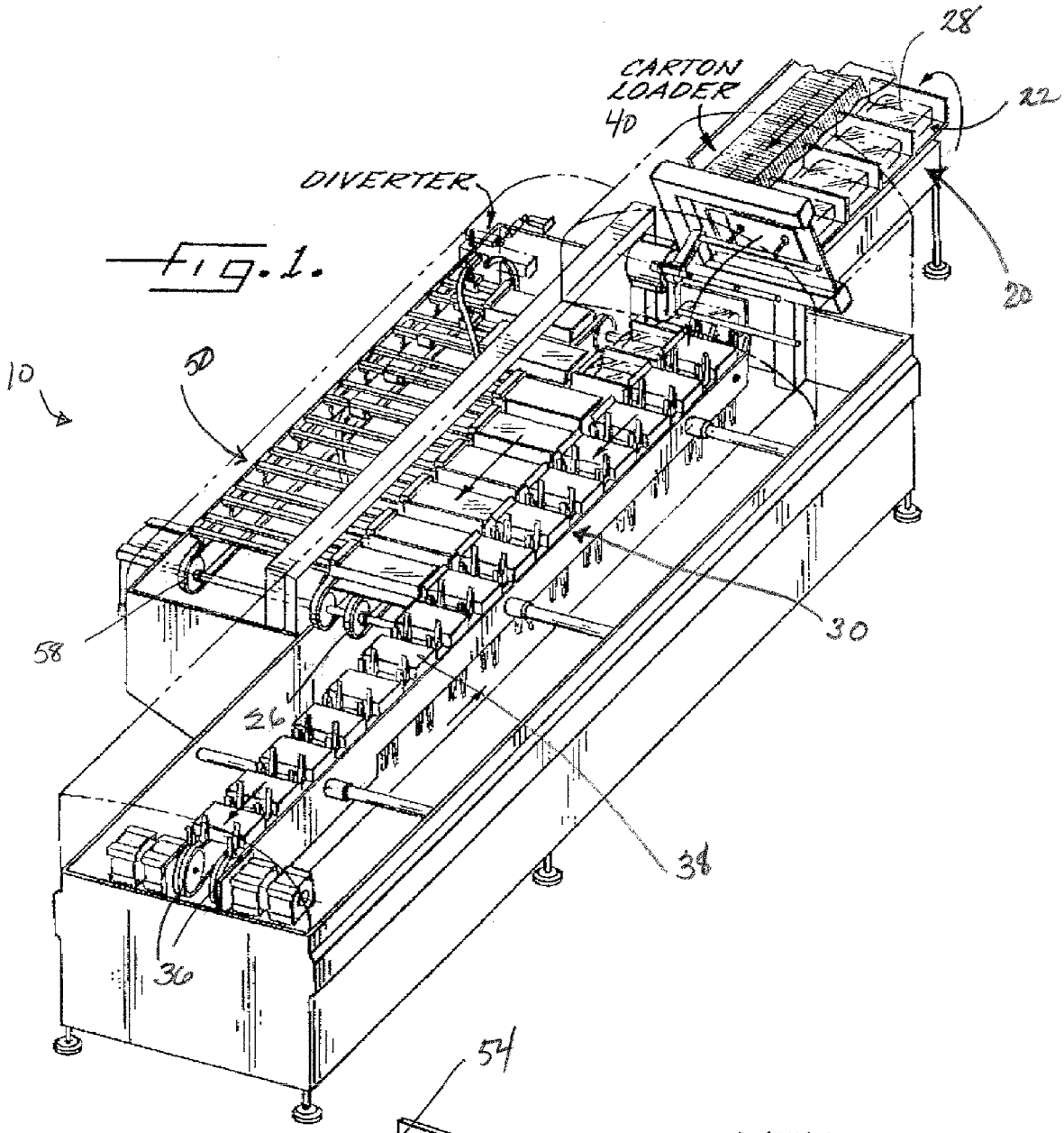
Figure 2:
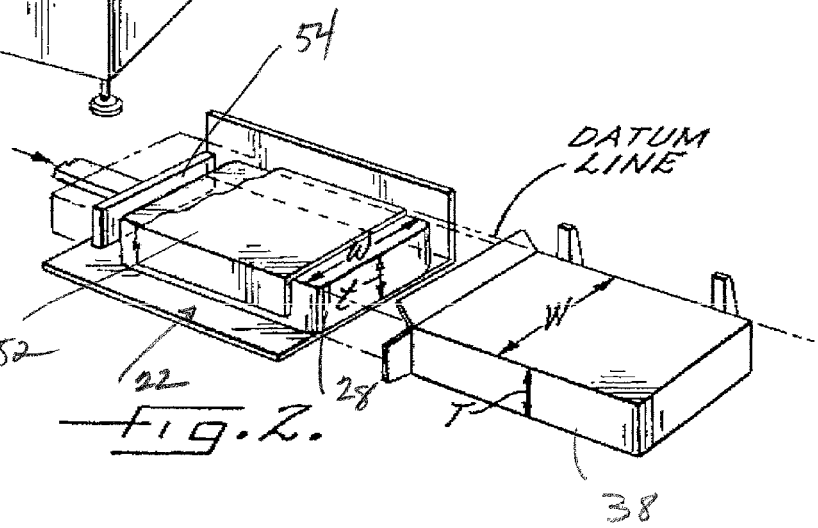
Figure 3:
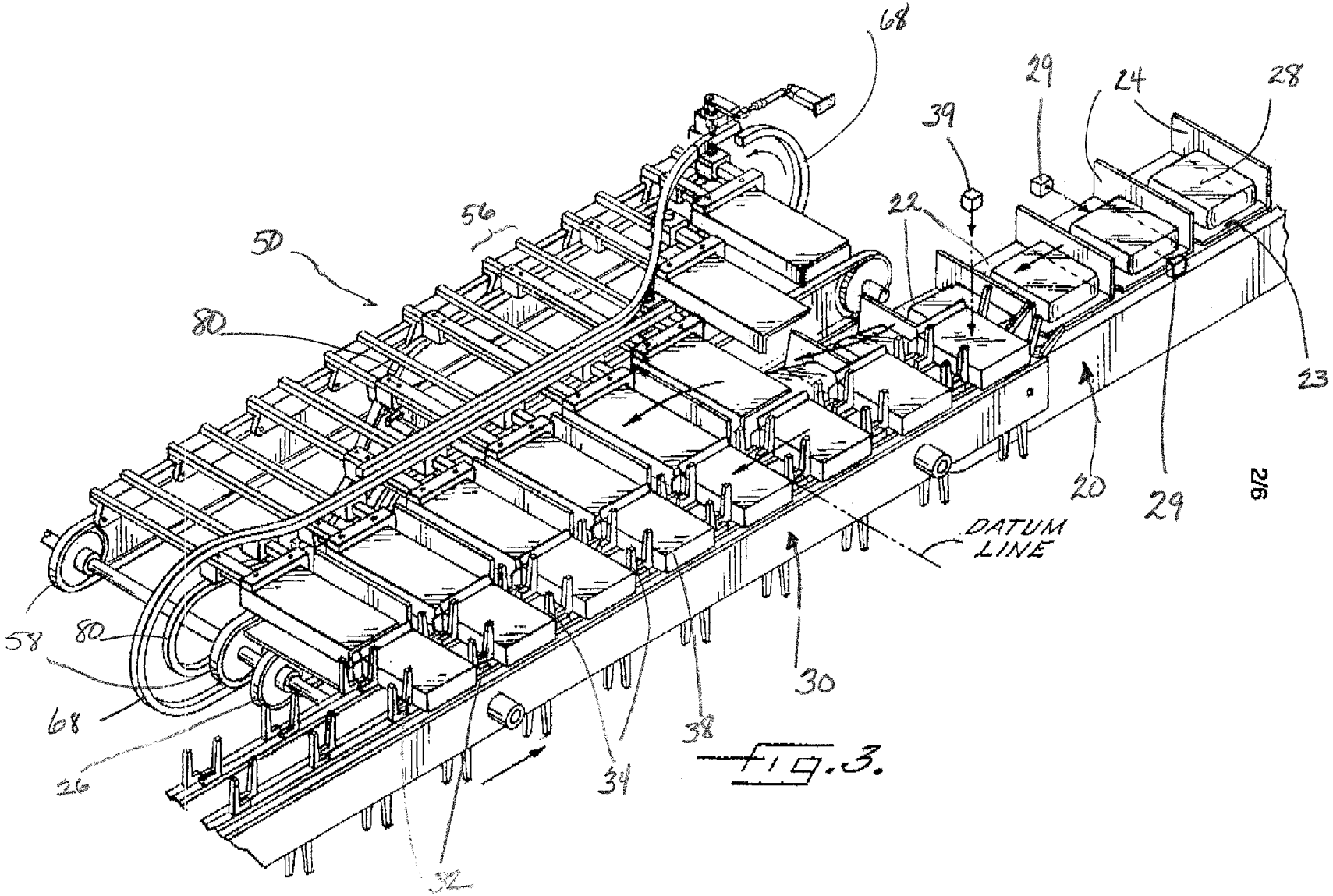
Figures 4, 5:
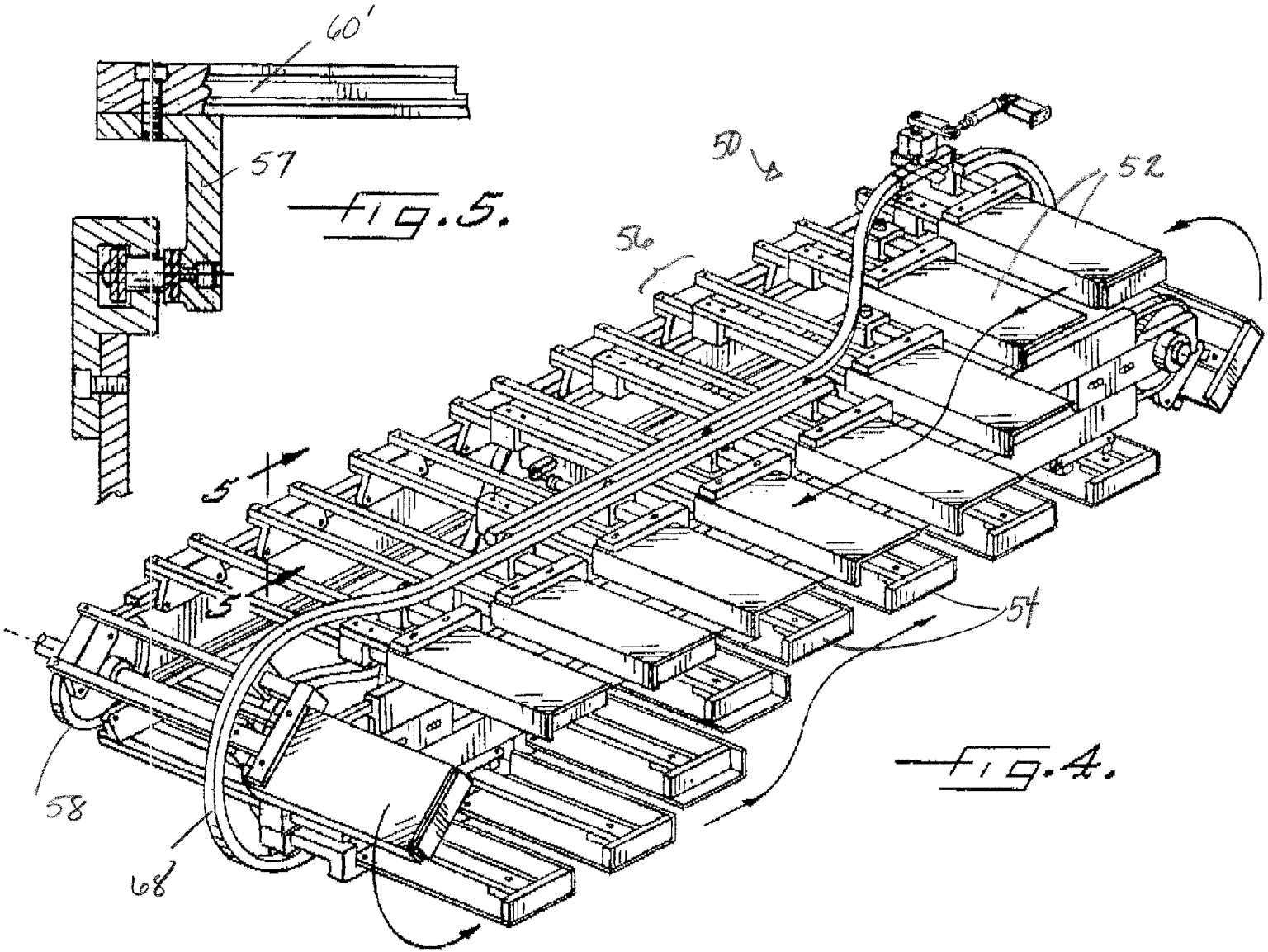
Figure 6:
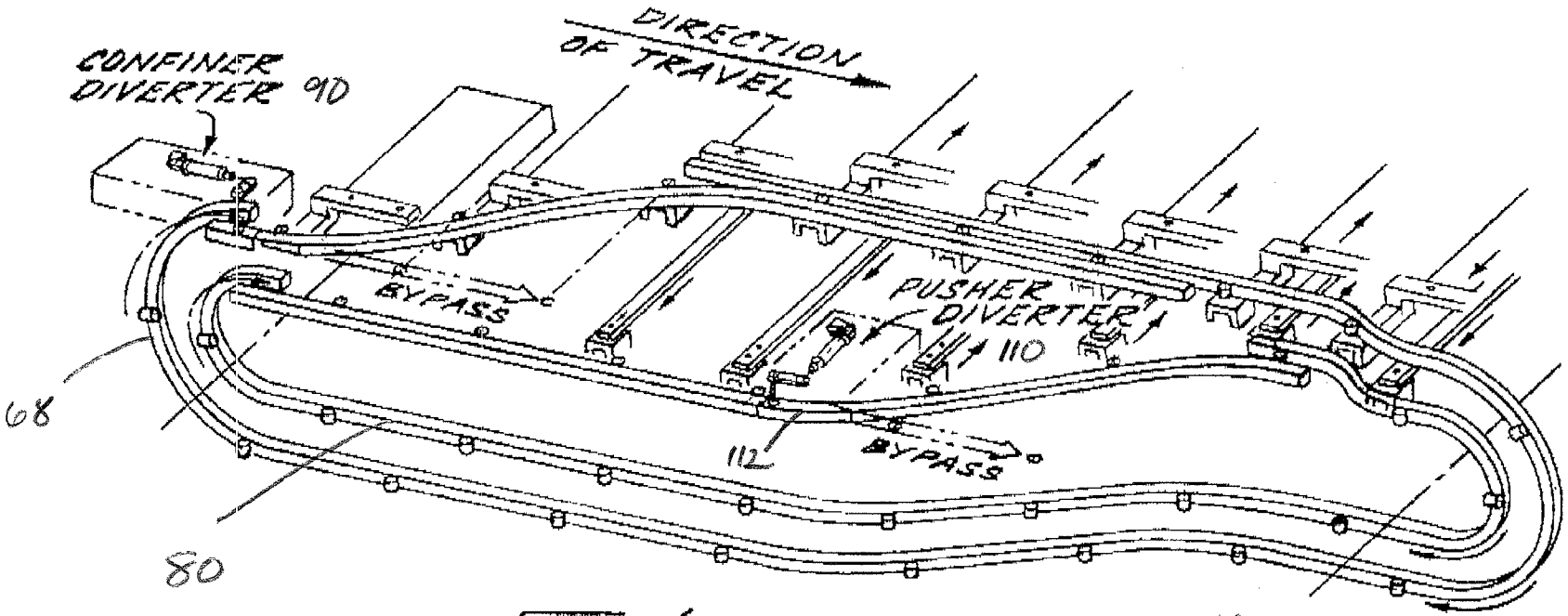
Figure 8:
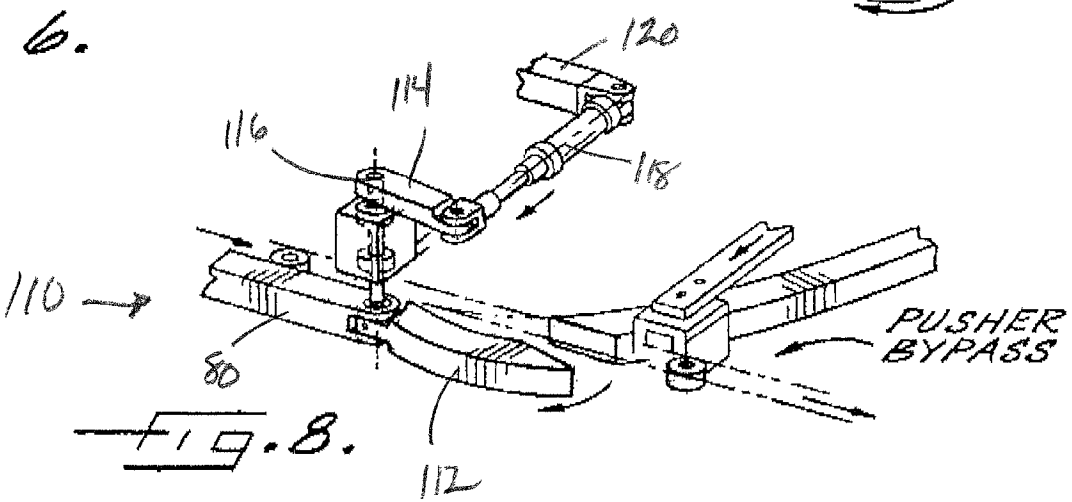
Figure 7A:
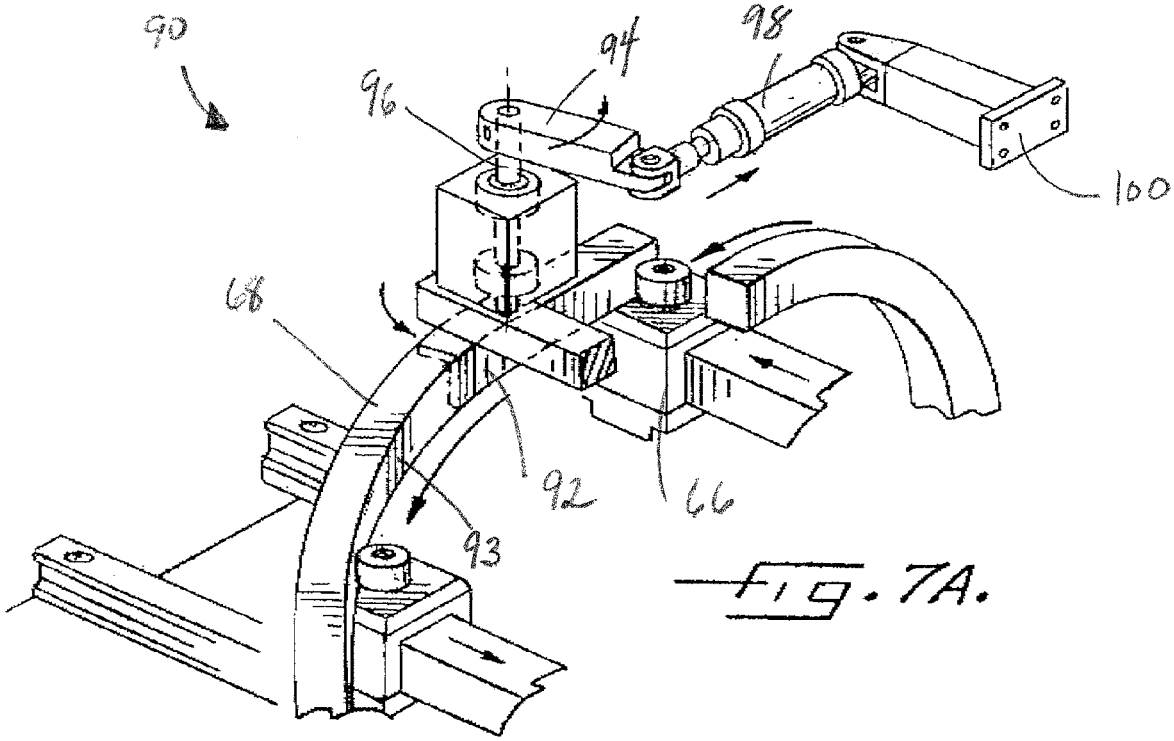
Figure 7B:
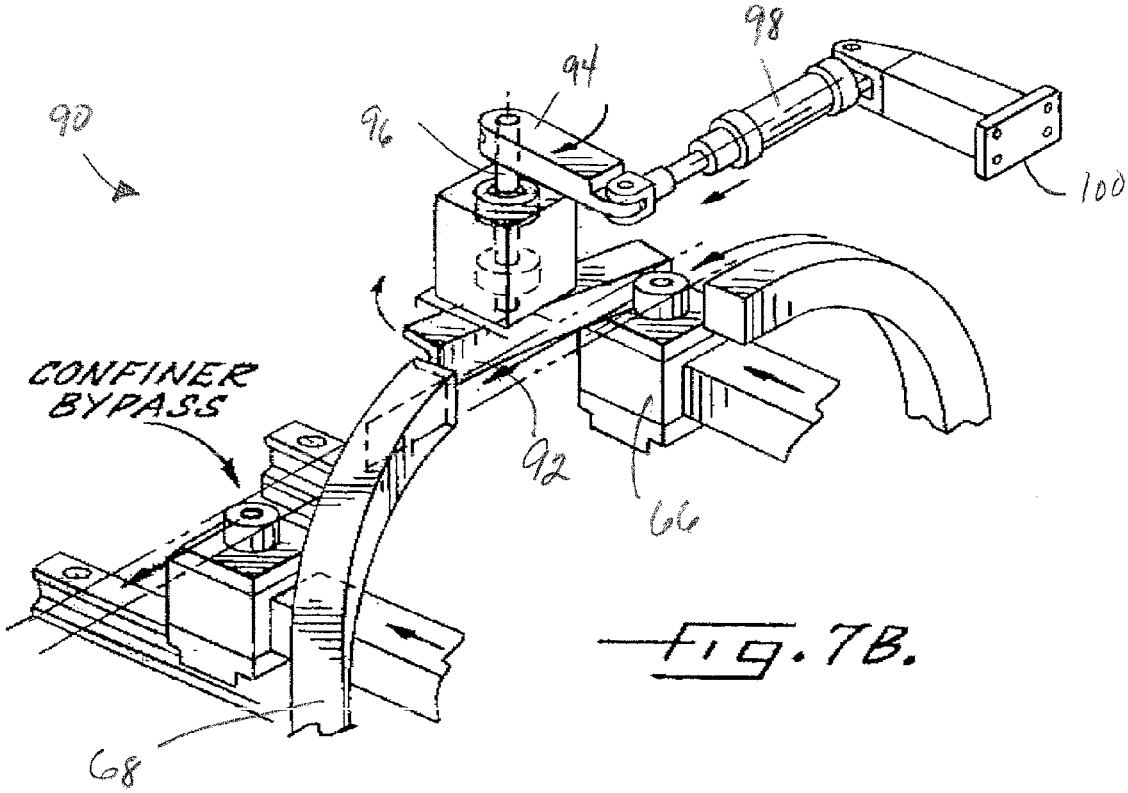
Figures 9A, 9B, 10:
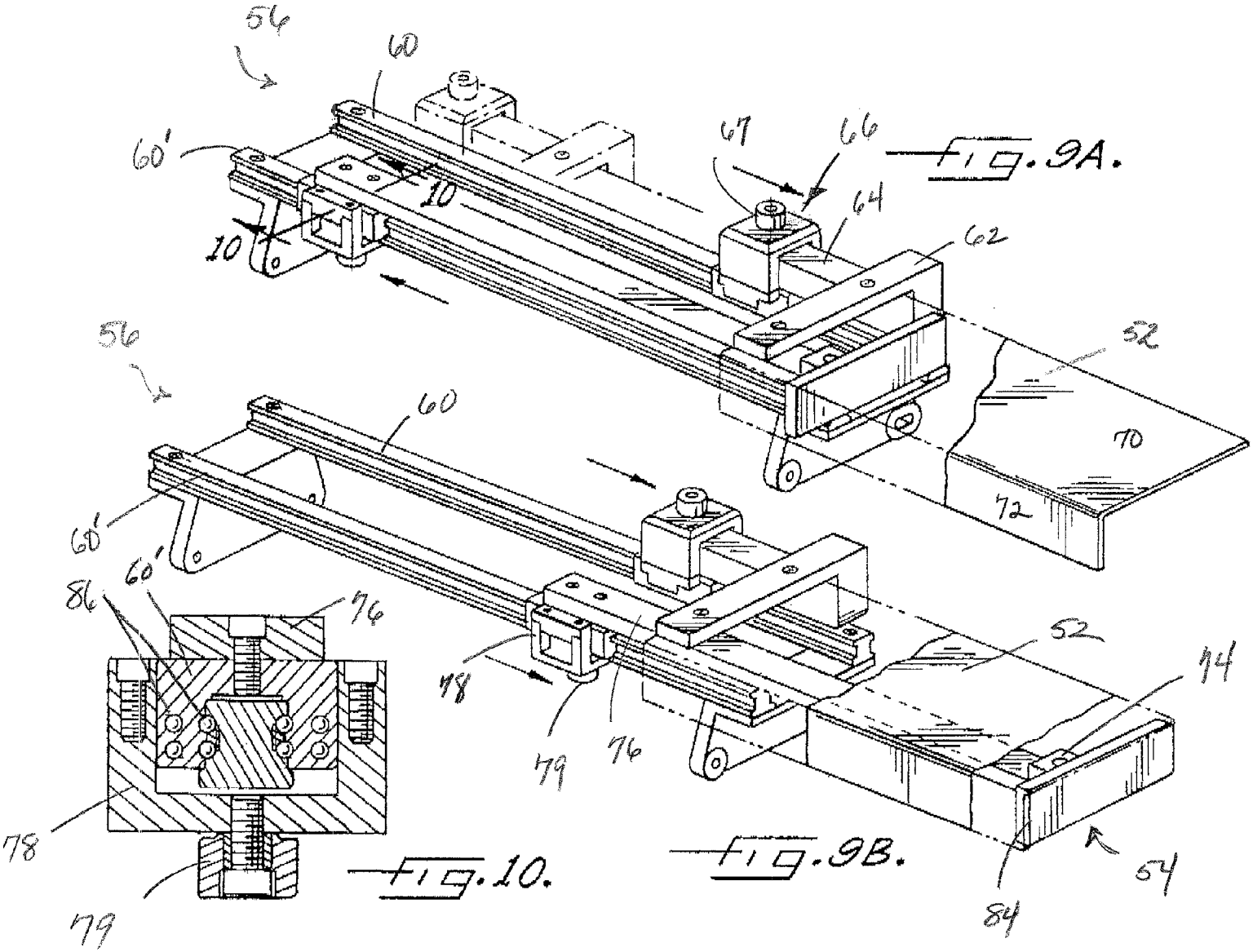

Having thus described the invention in general terms, reference will now be made to the accompanying drawings, which are not necessarily drawn to scale, and in which:

FIG. 1 is a top perspective view of an exemplary cartoning system in accordance with the present invention;

FIG. 2 is a fragmentary top perspective view of confiner and pusher elements of an integrated barrel loader/confiner in accordance with the present invention, demonstrating cooperation of the confiner and pusher elements to shape and introduce a product into a carton;

FIG. 3 is an enlarged fragmentary top perspective view of the cartoning system of FIG. 1;

FIG. 4 is an enlarged front perspective view of an integrated barrel loader/confiner in accordance with the present invention;

FIG. 5 is a cross sectional view of a confiner and pusher element carriage of the integrated barrel loader/confiner of FIG. 4 taken along line 5-5;

FIG. 6 is a rear perspective view of cam tracks, a confiner diverter system, and a pusher diverter system of the integrated barrel loader/confiner of FIG. 4;

FIGS. 7A and 7B are enlarged front perspective views of the confiner diverter system of FIG. 6;

FIG. 8 is an enlarged rear perspective of the pusher diverter system of FIG. 6;

FIGS. 9A and 9B are enlarged partially fragmented top perspective views of the confiner and pusher element carriage of the integrated barrel loader/confiner of the invention, demonstrating the lateral movement of the confiner and pusher elements thereof; and FIG. 10 is an enlarged cross sectional view of an inverted pusher cam follower of the confiner and pusher element carriage of FIG. 9A taken along line 10-10.

DETAILED DESCRIPTION OF THE INVENTION

The present invention now will be described more fully hereinafter in the following detailed description of the invention, in which some, but not all embodiments of the invention are described. Indeed, this invention may be embodied in many different forms and should not be construed as limited to the embodiments set forth herein; rather, these embodiments are provided so that this disclosure will satisfy applicable legal requirements. Like numbers refer to like elements throughout.

The terminology used herein is for the purpose of describing particular embodiments only and is not intended to be limiting of the invention. As used herein, the term "and/or" includes any and all combinations of one or more of the associated listed items. As used herein, the singular forms "a," "an," and "the" are intended to include the plural forms as well as the singular forms, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one having ordinary skill in the art to which this invention belongs. It will be further understood that terms, such as those defined in commonly used dictionaries, should be interpreted as having a meaning that is consistent with their meaning in the context of the relevant art and the present disclosure and will not be interpreted in an idealized or overly formal sense unless expressly so defined herein.

FIG. 1 is a top perspective view of an exemplary cartoning system, designated generally at 10, in accordance with various aspects of the invention. Cartoning system 10 can include many of the components found in cartoning systems known in the art, such as a product conveyor 20, a carton conveyor 30, and a carton loader 40. In addition, cartoning system 10 can include an integrated barrel loader/confiner 50 in accordance with the present invention, as described in more detail below.

Product conveyer 20 can be selected from any of the types of product conveyors as known in the packaging art. As illustrated in FIGS. 1 and 3, an exemplary product conveyer 20 useful in the present invention can include product buckets 22 defined by a horizontal bottom wall 23 and a plurality of spaced-apart vertical walls 24 supported on endless chain 26. A suitable product, typically a flexible pouch 28, is discharged upstream one at a time into a corresponding product bucket 22. Pouch 28 will typically have a generally irregular configuration after it is discharged into product bucket 22 so that its dimensions do not match the interior dimensions of a carton or package into which pouch 28 is to be inserted.

As illustrated in FIG. 3, cartoning system 10 can further include a pouch sensor 29 for detecting the presence or absence of a pouch 28 within a product bucket 22, and/or the orientation of a pouch 28 within product bucket 22, as product conveyor 20 approaches integrated barrel loader/pusher 50. Pouch sensor 29 can be any of the types of sensors known in the art suitable for detecting and communicating information about objects passing by the sensor. Pouch sensor 29 can be, for example, an active sensor or a passive sensor, and typically is an active sensor capable of sending out or transmitting a signal and receiving a reflection from its target to detect the object. Exemplary pouch sensors useful in the present invention include photoelectric sensors, also referred to as photoeyes, which can be an LED or laser which detects objects blocking or reflecting a light beam.

As discussed in more detail below with reference to FIGS. 6, 7A and 7B, integrated barrel loader/confiner 50 can include a confiner diverter system in electronic communication with pouch sensor 29. Based upon the information transmitted by pouch sensor 29 to the confiner diverter system, the confiner diverter system can divert a confiner element as defined herein when pouch sensor 29 detects the absence of or the misfeed (improper orientation) of a pouch 28.

Pouch 28 is conveyed in product bucket 22 past pouch sensor 29 and into a side-by side relationship with integrated barrel loader/confiner 50, described in more detail below. FIG. 3 illustrates product bucket 22 moving upwardly as it approaches integrated barrel loader/confiner 50. As product bucket 22 travels upwardly, pouch 28 can slide within product bucket 22, for example, toward a trailing wall portion of product bucket 22.

Cartoning apparatus 10 can further include carton conveyer 30, also as known in the art. As will be appreciated by the skilled artisan, carton conveyer 30 can include a plurality of leading transport lugs 32 and trailing transport lugs 34 supported on endless chains 36. Leading transport lugs 32 and trailing transport lugs 34 confine therebetween cartons 38 into which a product such as pouch 28 is to be loaded.

The cartoning apparatus can be useful for loading flexible pouches including any of a variety of products. Exemplary products include product in particulate form such as but not limited to dry cereal, crackers, cookies, frozen foods, and the like.

As also illustrated in FIG. 3, cartoning system 10 can further include a carton sensor 39 for detecting the presence or absence of a carton 38, and/or the position or orientation of a carton package 38, as carton conveyor 30 directs the cartons into a side-by-side relationship with integrated barrel loader/pusher 50 (with product conveyor 20 positioned therebetween). As with pouch sensor 29 discussed herein, carton sensor 39 also can be any of the types of sensors known in the art suitable for detecting and communicating information about objects passing by the sensor. Carton sensor 39 can be, for example, an active sensor or a passive sensor, and typically is an active sensor capable of sending out or transmitting a signal and receiving a reflection from its target to detect the object. Exemplary carton sensors useful in the present invention include photoelectric sensors, also referred to as photoeyes, which can be an LED or laser which detects objects blocking or reflecting a light beam.

As discussed in more detail with reference to FIGS. 6 and 8, integrated barrel loader/confiner 50 can also include a pusher diverter system in electronic communication with carton sensor 39. Based upon the information transmitted by carton sensor 39 to the pusher diverter system, the pusher diverter system can divert a pusher element as defined herein when package sensor 39 detects the absence of or the misfeed (improper orientation) of a carton 38.

Carton loader 40, also as known in the art, can be positioned upstream of carton conveyer 30. Generally in operation, a stack of cartons in an un-opened (or flat) configuration (not shown) is directed toward a suitable carton loader and the carton loader can direct a carton from the stack and into a corresponding space between leading transport lug 32 and trailing transport lug 34. Any suitable mechanism as known in the art can be used to feed a stack of cartons and to direct the cartons from the stack and onto the carton conveyor. As a non-limiting example, FIG. 1 illustrates a rotating apparatus including one or more vacuum cups (not illustrated) suitable for gripping a flat carton from a stack of cartons and moving the carton in a clockwise direction from the stack of flat cartons and onto carton conveyer 30 in an open configuration. The details of the structure and operation of carton loader 40 are well known in the cartoning art and will be readily understood by the skilled artisan.

Cartoning apparatus 10 further includes integrated barrel loader/confiner 50, an enlarged front perspective view of which is illustrated in FIG. 4. As described in more detail herein, integrated barrel loader/confiner 50 includes a plurality of confiner elements 52 for imparting dimensions to pouch 28 which are similar to the interior dimensions of carton 38 into which the pouch is to be pushed. Integrated barrel loader/confiner 50 further includes a plurality of pusher elements 54 for pushing pouch 28, the shape of which has been conformed by confiner element 52, into corresponding carton 38.

Confiner elements 52 and pusher elements 54 are endlessly driven and cammed first to conform or confine the shape of product pouch 28 and thereafter to drive the conformed or confined product pouch 28 into carton 38, respectively, as discussed in more detail herein. In particular, integrated barrel loader/confiner 50 includes a mechanism for gradually moving a confiner element 52 into juxtaposition with a corresponding product bucket 22 to confine a pouch 28 carried in the product bucket 22 to the desired dimensions. In the present invention, the same mechanism also gradually moves a pusher element 54 into juxtaposition with the cooperating confiner element 52/product bucket 22 holding the confined pouch 28 to drive the thus confined pouch into a carton 38.

FIGS. 3 and 4 illustrate an exemplary carrier mechanism in the form of a plurality of confiner element/pusher element carriages 56. Each carriage 56 is endlessly driven by endless chains 58 in the machine direction of integrated barrel loader/confiner 50, as illustrated in FIGS. 1, 3 and 4. FIG. 5, an enlarged cross sectional view of carriage 56 taken along line 5-5 of FIG. 4, illustrates an exemplary non-limiting structure for attaching a carriage 56 via a pair of opposing brackets 57 to endless chains 58.

Each carriage 56 has a paired confiner element 52 and a pusher element 54. In operation, an individual pouch 28 and corresponding carton 38 can be carried by product conveyer 20 and carton conveyor 30, respectively, so that the pouch 28 and the corresponding carton 38 into which the pouch 28 is to be driven are arranged side-by-side, with the pouch 28 adjacent integrated barrel loader/confiner 50, as illustrated, for example, in FIGS. 1 and 3. Each carriage 56 operates to align in sequence first the confiner element 52 and thereafter the pusher element 54 with an incoming pouch 28 and corresponding carton 38. In this manner, carriage 56 can position a confiner element 52 so that the confiner element can conform or confine the pouch, and thereafter the carrier can position a pusher element 54 to drive the confined pouch into the corresponding carton.

FIGS. 9A and 9B are enlarged partially fragmented top perspective views of an exemplary confiner element/pusher element carriage 56, demonstrating the independent lateral movement of each of the confiner and pusher elements. Each carriage 56 allows independent movement of confiner element 52 and pusher element 54 in a cross machine direction from a retracted position outwardly to an extended position to allow a paired confiner element 52 and pusher element 54 to first conform and thereafter drive product pouch 28 into carton 38.

Carriage 56 includes parallel tracks or guide rods 60, 60', positioned in the transverse (cross machine) direction of integrated barrel loader/confiner 50. Tracks or guide rods 60, 60' provide a track for the independent outward lateral movement of confiner element 52 and pusher element 54, respectively.

Confiner element 52 is movably attached to guide rod 60 to allow movement of the confiner element in the cross machine direction. Confiner element 52 can be movably attached to guide rod 60 with a bracket 62 including a confiner cam arm 64 carrying a confiner cam follower 66 including a confiner cam 67. Confiner cam 67 of confiner cam follower 66 rides in an endless confiner cam track 68, as illustrated for example in FIGS. 3, 4, and 6.

FIG. 9A illustrates the range of lateral movement of confiner element 52 from a fully retracted position (in broken lines) to a fully extended position. The configuration of confiner cam track 68 determines in large part the path of movement taken by each confiner element 52. More particularly, the specific position of confiner element 52 at any given point along the machine direction of integrated barrel loader/confiner 50 is determined by the position of confiner cam 67 of confiner cam follower 66 along confiner cam track 68. Thus, as illustrated in FIG. 4, as endless chains 58 drive carriage 56 in the machine direction of integrated barrel loader/confiner 50, confiner cam 67 of confiner cam follower 66 rides in confiner cam track 68. As confiner cam 67 of confiner cam follower 66 travels along confiner cam track 68 from an upstream position of integrated barrel loader/confiner 50 to a downstream position, confiner cam track 68 directs confiner cam 67 of confiner cam follower 66 from a position opposite product conveyor 20 and generally diagonally across the integrated barrel loader/confiner 50 and to a position adjacent product conveyor 20. In this manner, confiner element 52 is gradually extended over a corresponding pouch 28 contained within adjacent product bucket 22 to allow the confiner element 52 to conform the shape of the incoming pouch 28.

Confiner elements 52 can have an inverted L shape defined by a horizontal top wall 70 and a leading vertical side wall 72. During that portion of the movement of product conveyor 20 into a side-by-side position relative to integrated barrel loader/confiner 50, confiner cam track 68 directs the movement of confiner element 52 to juxtapose confiner element 52 to a corresponding product bucket 22 to create a substantially rectangular shape with dimensions substantially the same as the inside dimensions of the carton into which the pouch is to be driven. Thus, as illustrated in FIG. 3, in operation, as product bucket 22 and confiner element 52 move together, leading vertical wall 72 of confiner element 52 moves into engagement with the leading edge of the pouch 28 and gradually forces pouch 28 toward the vertical trailing wall of product bucket 22. When the confiner element 52 reaches its final position, the pouch has been reshaped by the cooperative action of product bucket 22 and confiner element 52 into a generally rectangular configuration with dimensions that are substantially the same as the inside dimensions of the carton into which the pouch is to be inserted. See, for example, FIG. 2, which illustrates the cooperation of confiner element 52 with product bucket 22 to conform pouch 28 to dimensions "w" and "t" selected as suitable for introduction of the pouch into a carton 38 having interior dimensions "W" and "T" by pusher element 54.

Referring again to FIGS. 9A and 9B, pusher element 54 is also movably attached to guide rod 60' to allow movement of the pusher element in the cross machine direction. Similar to confiner element 52, pusher element 54 can be movably attached to guide rod 60' with a bracket 74 including a pusher cam arm 76 carrying an inverted pusher cam follower 78 including a pusher cam 79. Pusher cam 79 of inverted pusher cam follower 78 rides in an endless pusher cam track 80, as best illustrated in FIGS. 3 and 6.

FIG. 10 is an enlarged cross sectional view of FIG. 9A taken along line 10-10 and illustrates an exemplary linear slide assembly for providing linear motion of inverted pusher cam follower 78. Inverter pusher cam follower 78 can include any linear slide assembly suitable for linear motion, such as a ball rail system (including ball rail systems including double recirculating roller balls 86 as illustrated), a roller rail system, a cam roller system, and the like, as known in the art. The present invention is not limited, however, to the illustrated linear slide assembly of FIG. 10, and any assembly suitable for linear motion of the inverted pusher cam follower can be used. Similar assemblies suitable for the linear motion of confiner cam follower 66 can also be used in accordance with the present invention.

FIGS. 9A and 9B also illustrate the range of lateral movement of pusher element 54 from a fully retracted position (FIG. 9A, which is first in sequence during operation of the carrier) to a fully extended position (FIG. 9B). The configuration of pusher cam track 80 determines in large part the path of movement taken by each pusher element 54. More particularly, the specific position of pusher element 54 at any given point along the machine direction of integrated barrel loader/confiner 50 is determined by the position of inverted pusher cam follower 78 along pusher cam track 80. Thus, as illustrated in FIGS. 3 and 4, as endless chains 58 drive carriage 56 in the machine direction of integrated barrel loader/confiner 50, inverted pusher cam follower 78 rides in pusher cam track 80 (which underlies confiner cam track 68). As inverted pusher cam follower 78 travels along pusher cam track 80 from an upstream position of integrated barrel loader/confiner 50 to a downstream position, pusher cam track 80 directs inverted pusher cam follower 78 from a position opposite product conveyor 20 and generally diagonally across the integrated barrel loader/confiner 50 and to a position adjacent product conveyor 20. Pusher cam track 80 is designed so that the movement of pusher element 54 diagonally across integrated barrel loader/confiner 50 lags behind the movement of confiner element 52, so that pusher element 54 aligns with pouch 28 after confiner element 52 has aligned with and conformed the pouch in preparation for pusher element 54 to drive the confirmed pouch into a carton. In this manner, pusher element 54 is gradually extended to a position side-by-side with juxtaposed confiner element 52/product bucket 22, within which pouch 28 is conformed to a desired shape, to drive the pouch into a carton 38.

Pusher elements 54 can have a conventional shape as known in the art. Typically pusher elements 54 include a pusher face 84 positioned so that an outer surface of pusher face 84 cooperates with an end of the pouch 28. Pusher face 84 has dimensions that are substantially the same as the dimensions of the inside of carton 38 and can have any suitable shape, depending on the shape of carton 38 (typically rectangular as shown).

During that portion of the movement of product conveyor 20 into a side-by-side position relative to integrated barrel loader/confiner 50 and following confinement of pouch 28 by the cooperating position of confiner element 52 and product bucket 22, pusher cam track 80 directs the movement of pusher element 54 to engage pusher element 54 with the pouch 28 and to begin to drive the pouch 28 into carton 38. Because the pouch has been shaped by the juxtaposition of confiner element 54 and product bucket 22 to dimensions suitable for insertion into carton 38, the pouch 28 can be readily inserted into carton 38 with minimal risk that the pouch will jam.

During operation of cartoning system 10, if an improperly oriented pouch continues through the confining/pushing sequence described herein, the pouch can jam the cartoning system. This in turn can shut down the system and result in loss of productivity during the time required by an operator to locate the source of the problem and restore operation of the system. To minimize lost productivity resulting from product jams, the cartoning system of the invention can include a system for detecting absent or improperly oriented pouches and for diverting a confiner element associated with the product bucket without a pouch or containing an improperly oriented pouch prior to the confining and pushing operations performed by integrated barrel loader/confiner 50.

In this regard, as referenced above, and as illustrated in FIG. 3, cartoning system 10 can include a pouch sensor 29 for detecting the presence or absence of a pouch 28 within a product bucket 22, and/or the orientation of a pouch 28 within product bucket 22, as product conveyor 20 approaches integrated barrel loader/pusher 50. Pouch sensor 29 is in communication with a confiner diverter system, designated generally at 90 in FIGS. 6, 7A and 7B.

Confiner diverter system 90 is operable to engage a confiner cam follower 66 associated with a missing or improperly oriented pouch to prevent a confiner element 52 carried by the confiner cam follower 66 from being cammed toward the product bucket 22. Confiner diverter system 90 includes a confiner diverter gate 92 which is pivotably mounted to confiner cam track 68 and which has two positions. The first position, shown in FIG. 7A, is in alignment with confiner cam track 68 to define the path of the confiner cam follower 66 in standard operating mode. The first position permits confiner cam follower 66 to move along an inner surface 93 of confiner cam track 68 and thereafter diagonally across barrel loader/confiner 50 to confine a pouch as described herein.

In the second position, shown in FIG. 7B, confiner diverter gate 92 is pivoted outwardly away from confiner cam track 68 when pouch sensor 29 detects a missing or improperly oriented pouch. When in this position, confiner cam follower 66 will be thrust to the outside surface of confiner cam track 68 and will not follow the normal operating path (i.e., confiner cam follower 66 will be directed into a bypass mode).

Pivotable confiner diverter gate 92 is shifted between the two operative positions by a diverter arm 94, which is operatively connected at a first end to gate 92 by pin 96 and operatively connected at an opposing end to a double acting piston and cylinder 98. Piston and cylinder 98 is operatively connected to a sensor 100, which is in electronic communication with pouch sensor 29 to receive information from sensor 29 regarding the presence or absence of a pouch, or the improper orientation of a pouch, in a product bucket as detected by sensor 29.

Similar to an improperly oriented pouch, during operation of the cartoning system 10, if an improperly oriented carton continues through the confining/pushing sequence described herein, the carton can also jam the cartoning system. This in turn can shut down the system and result in loss of productivity during the time required by an operator to locate the source of the problem and restore operation of the system. To minimize lost productivity resulting from carton jams, the cartoning system of the invention can include a system for detecting absent or improperly oriented cartons and for diverting a pusher element associated with a missing or improperly oriented carton prior to the confining and pushing operations performed by integrated barrel loader/confiner 50.

In this regard, as referenced above, and as illustrated in FIG. 3, cartoning system 10 can include a carton sensor 39 for detecting the presence or absence of a carton 38 on carton conveyor 30, and/or the orientation of a carton 38 on carton conveyor 30, as carton conveyor 30 approaches integrated barrel loader/pusher 50. Carton sensor 39 is in communication with a pusher diverter system, designated generally at 110 in FIGS. 6 and 8.

Pusher diverter system 110 is operable to engage a pusher cam follower 78 associated with a missing or improperly oriented carton to prevent a pusher element 54 carried by the pusher cam follower from being cammed toward the carton. Pusher diverter system 110 includes a pusher diverter gate 112 which is pivotably mounted at one end thereof to pusher cam track 80 and which has two positions. The first position, shown in FIG. 6, is in alignment with pusher cam track 80 to define the path of the pusher cam follower 78 in standard operating mode. The first position permits pusher cam follower 78 to move along an inner surface of pusher cam track 80 and thereafter diagonally across barrel loader/confiner 50 to drive a pouch into a carton described herein.

In the second position, shown in FIG. 8, pusher diverter gate 112 is pivoted outwardly away from pusher cam track 80 when carton sensor 39 detects a missing or improperly oriented carton. When in this position, pusher cam follower 78 will be thrust to the outside of pusher cam track 80 and will not follow the normal operating path (i.e., pusher cam follower 78 will be directed into a bypass mode).

Pivotable pusher diverter gate 112 is shifted between the two operative positions by a diverter arm 114, which is operatively connected at a first end to gate 112 by pin 116 and operatively connected at an opposing end to a double acting piston and cylinder 118. Piston and cylinder 118 is operatively connected to a sensor 120, which is in electronic communication with carton sensor 39 to receive information from sensor 39 regarding the presence or absence of a carton, or the improper orientation of a carton, on package conveyor 30 as detected by sensor 39.

In operation of the invention, pouches 28 and cartons 38 are conveyed past the integrated barrel loader/confiner 50 in alignment with each other and in alignment with the respective confiner elements 52 and pusher elements 54. As the pouches and cartons move downstream, confiner cam followers 66 and pusher cam followers 78 travel along confiner and pusher cam tracks 68 and 80, respectively. Confiner cam followers 66 cam confiner elements 52 to cooperate with a coordinating product bucket 22 and confine a pouch 28, and pusher cam followers 78 cam pusher elements 54 into the pouch 28 to drive the pouch into a carton 38. If pouch detector 29 detects a missing or improperly oriented pouch on product conveyor 20, it will trigger the operation of confiner diverter gate 92. The gate 92 will swing outwardly causing confiner cam follower 66 to ride around the outer surface of confiner cam track 68, as shown in FIG. 7B, and there is no engagement of the confiner element with the pouch.

Similarly, if carton detector 39 detects a missing or improperly oriented carton on carton conveyor 30, it will trigger the operation of pusher diverter gate 112. The gate 112 will swing outwardly causing pusher cam follower 78 to ride around the outer surface of pusher cam track 80, as shown in FIG. 8, and there is no engagement of the pusher element with the pouch. In either case, a redirected pouch and/or carton can simply drop into a bin or other suitable container at the end of the integrated barrel loader/confiner 50.

In the specification, drawings, and examples, there have been disclosed typical embodiments of the invention and, although specific terms have been employed, they have been used in a generic and descriptive sense only and not for purposes of limitation, the scope of the invention being set forth in the following claims.

That which is claimed is:

1. An integrated barrel loader/confiner apparatus useful in a cartoning system for shaping and inserting a product into a carton, comprising:

a first endless cam track defining a path of movement for a confiner element to conform a conformable product;

a plurality of confiner element endlessly driven along said first cam track;

a second endless cam track defining a path of movement for a pusher element to drive a conformed product into a carton;

a plurality of pusher element endlessly driven along said second cam track;

a carriage carrying a confiner element and a pusher element; and an endless chain driving said carriage;

wherein said carriage further comprises:

a first carriage track defining a path along which said confiner element travels in a cross machine direction from a retracted position outwardly to an extended position;

a confiner cam follower attached to said confiner element slidably mounting said confiner element to said first carriage track;

a confiner cam attached to said confiner cam follower and cooperating with said first cam track to drive said confiner element along said first cam track, wherein said confiner element travels from said retracted position outwardly to said extended position along said first carriage track as said confiner cam travels along said first cam track;

a second carriage track parallel to said first carriage track defining a path along which said pusher element travels in a cross machine direction from a retracted position outwardly to an extended position;

a pusher cam follower attached to said pusher element slidably mounting said pusher element to said second carriage track; and a pusher cam attached to said pusher cam follower and cooperating with said second cam track to drive said pusher element along said second cam track, wherein said pusher element travels from said retracted position outwardly to said extended position along said second carriage track as said pusher cam travels along said second cam track.

2. The integrated barrel loader/confiner apparatus of claim 1, wherein said second cam track underlies said first cam track and wherein said pusher cam follower is inverted and slidably mounted to a lower surface of said second carriage track.

3. The integrated barrel loader/confiner apparatus of claim 1, wherein said second cam track is shaped so that the travel of said pusher element along said second carriage track lags the travel of said confiner element along said first carriage track.

4. The integrated barrel loader/confiner apparatus of claim 1, wherein said confiner element has an inverted L shape defined by a horizontal top wall and a leading vertical wall.

5. The integrated barrel loader/confiner apparatus of claim 1, further comprising a confiner diverter system to engage said confiner cam follower to prevent said confiner element carried by said confiner cam follower from being cammed.

6. The integrated barrel loader/confiner apparatus of claim 5, wherein said confiner diverter system comprises a confiner diverter gate pivotably mounted to said first cam track between a first position in which said confiner diverter gate is in alignment with said first cam track and a second position in which said confiner diverter gate is pivoted outwardly away from said first cam track.

7. The integrated barrel loader/confiner apparatus of claim 1, further comprising a pusher diverter system to engage said pusher cam follower to prevent said pusher element carried by said pusher cam follower from being cammed.

8. The integrated barrel loader/confiner apparatus of claim 7, wherein said pusher diverter system comprises a pusher diverter gate pivotably mounted to said second cam track between a first position in which said pusher diverter gate is in alignment with said second cam track and a second position in which said pusher diverter gate is pivoted outwardly away from said second cam track.

9. A cartoning system, comprising:

a product conveyor comprising a series of product buckets;

an integrated barrel loader/confiner adjacent said product conveyor, comprising: a first endless cam track defining a path of movement for a confiner element to juxtapose said confiner element with a product bucket; a plurality of confiner elements endlessly driven along said first cam track; a second endless cam track defining a path of movement for a pusher element to position said pusher element adjacent a juxtaposed confiner element and product bucket; a plurality of pusher elements endlessly driven along said second cam track; a carriage carrying a confiner element and a pusher element; and an endless chain driving said carriage, wherein said carriage further comprises:

a first carriage track defining a path along which said confiner element travels in a cross machine direction from a retracted position outwardly to an extended position;

a confiner cam follower attached to said confiner element slidably mounting said confiner element to said first carriage track;

a confiner cam attached to said confiner cam follower and cooperating with said first cam track to drive said confiner element along said first cam track, wherein said confiner element travels from said retracted position outwardly to said extended position along said first carriage track as said confiner cam travels along said first cam track;

a second carriage track parallel to said first carriage track defining a path along which said pusher element travels in a cross machine direction from a retracted position outwardly to an extended position;

a pusher cam follower attached to said pusher element slidably mounting said pusher element to said second carriage track; and a pusher cam attached to said pusher cam follower and cooperating with said second cam track to drive said pusher element along said second cam track, wherein said pusher element travels from said retracted position outwardly to said extended position along said second carriage track as said pusher cam travels along said second cam track.

10. The cartoning system of claim 9, wherein said second cam track underlies said first cam track and wherein said pusher cam follower is inverted and slidably mounted to a lower surface of said second carriage track.

11. The cartoning system of claim 9, wherein said second cam track is shaped so that the travel of said pusher element along said second carriage track lags the travel of said confiner element along said first carriage track.

12. The cartoning system of claim 9, further comprising a confiner diverter system to engage said confiner cam follower to prevent said confiner element carried by said confiner cam follower from being cammed.

13. The cartoning system of claim 12, wherein said confiner diverter system comprises:

a product sensor for detecting the absence or improper orientation of a product carried in a product bucket; and a confiner diverter gate pivotably mounted to said first cam track between a first position in which said confiner diverter gate is in alignment with said first cam track and a second position in which said confiner diverter gate is pivoted outwardly away from said first cam track when the absence or improper alignment of a product is detected and communicated by said product sensor to said confiner diverter system.

14. The cartoning system of claim 9, further comprising a pusher diverter system to engage said pusher cam follower to prevent said pusher element carried by said pusher cam follower from being cammed.

15. The cartoning system of claim 14, wherein said pusher diverter system comprises:

a carton sensor for detecting the absence or improper orientation of a carton carried by a carton conveyor; and a pusher diverter gate pivotably mounted to said second cam track between a first position in which said pusher diverter gate is in alignment with said second cam track and a second position in which said pusher diverter gate is pivoted outwardly away from said second cam track when the absence or improper alignment of a carton is detected and communicated by said carton sensor to said pusher diverter system.

16. The cartoning system of claim 9, further comprising a carton conveyor extending parallel to said product conveyor and positioned so that said product conveyor is between said carton conveyor and said integrated barrel loader/confiner, wherein said second cam track further defines a path of movement for said pusher element through said juxtaposed confiner element and product bucket to drive a product when present in said product bucket into a carton when carried by said carton conveyor.

17. The cartoning system of claim 7, wherein said product buckets are defined by a horizontal bottom wall and spaced-apart vertical walls.

18. The cartoning system of claim 17 wherein said confiner element has an inverted L shape defined by a horizontal top wall and a leading vertical wall, and wherein said first cam track defines a path of movement for said confiner element to juxtapose said confiner element with said product bucket to define a generally rectangular shape.

19. The cartoning system of claim 18 wherein said product bucket includes a conformable product and wherein said leading vertical wall of said confiner element engages a leading surface of said conformable product and gradually forces the product rearward while said horizontal top wall confines said product.

* * * * *